United States Patent [19]

Mazur et al.

[11] 4,393,960

[45] Jul. 19, 1983

[54] LOW NOISE RAILROAD RETARDER BRAKE SHOE STRUCTURE

[75] Inventors: Michael B. Mazur; Emil M. Punko, both of Brookfield, Wis.

[73] Assignee: AAA Sales & Engineering, Inc., Oak Creek, Wis.

[21] Appl. No.: 226,790

[22] Filed: Jan. 21, 1981

[51] Int. Cl.[3] ..... B61K 7/02

[52] U.S. Cl. ..... 188/62; 188/250 E; 104/26 A; 238/148; 238/382

[58] Field of Search ..... 104/26 A; 188/62, 218 A, 188/250 B, 250 G, 250 E, 250 R, 251 M, 255, 261; 238/148, 17, 382

[56] References Cited

U.S. PATENT DOCUMENTS

| | | | |
|---|---|---|---|
| 2,851,132 | 9/1958 | James | 188/261 |
| 3,140,762 | 7/1964 | Tross | 188/261 |
| 3,184,009 | 5/1965 | Reinsch | 188/251 M |
| 3,321,048 | 5/1967 | Wigton et al. | 188/62 |
| 3,716,114 | 2/1973 | Beck | 188/62 |
| 3,768,600 | 10/1973 | Beck | 188/62 |
| 3,838,646 | 10/1974 | Smith et al. | 188/264 B |
| 3,874,298 | 4/1975 | Smith et al. | 104/26 A |
| 4,003,451 | 1/1977 | Torok | 188/62 |
| 4,267,902 | 5/1981 | Schüpbach et al. | 188/62 |

FOREIGN PATENT DOCUMENTS

| | | | |
|---|---|---|---|
| 1067473 | 12/1979 | Canada | 188/62 |
| 42-702 | 7/1967 | Japan | 188/251 M |

OTHER PUBLICATIONS

"BN Studies Retarder Noise Abatement", *Railway System Controls,* Nov. 1972, pp. 14–17, 20.

*Primary Examiner*—Douglas C. Butler
*Assistant Examiner*—R. R. Diefendorf
*Attorney, Agent, or Firm*—Andrus, Sceales, Starke & Sawall

[57] ABSTRACT

A brake shoe structure includes a series of alternating long brake shoes and short brake shoes mountable on adjacent brake beams in a railroad car retarder. The length of the long brake shoe is such that the long brake shoe symmetrically straddles two adjacent brake beams. The length of the short brake shoe is such that the shoe occupies the spacing on the brake beams between two long brake shoes. The long brake shoes are affixable to each of the brake beams at at least two points. The brake shoes contain a plurality of slanting slots in their braking surfaces for interrupting harmonics producing screeching noises during retardation. The brake shoes may be formed of steel or heat treatable ductile iron.

17 Claims, 8 Drawing Figures

40A
48
46
44
54
56
4
4
46a
46b
56

54
46
48

40B
48
44
54
56
54
56

44
48
40C
56
54
56
58
7
7
54
56

44
48
56
40D
54
46a
46b
56

56
48
44
58
46

LOW NOISE RAILROAD RETARDER BRAKE SHOE STRUCTURE

DESCRIPTION

TECHNICAL FIELD

Railroad cars are assembled into freight trains in a railroad classification yard. The railroad cars pass along a main or lead track and through switches that divert them to branch tracks where each train is formed. The cars coast through the switches and along the tracks after being pushed down a hill or "hump" in the main line by a locomotive.

It is necessary to control the speed of the railroad cars as they move through the classification yard to insure they transit the tracks and switches safely and to avoid damage to the cars or contents as each car is added to the trains. Such speed control is accomplished by railroad car retarders.

BACKGROUND ART

Railroad car retarders are located beside the rails of the tracks. The retarder has elongated brake shoes, typically of steel, positioned on each side of the rails. The shoes move toward each other to pinch the wheels as a car moves through the retarder to slow its motion. The brake shoes are mounted on brake beams connected to levers operated by fluid cylinders.

The contact of the steel brake shoes with the steel car wheels produces a highly objectionable screeching noise as the car moves through the retarder. This noise may be hazardous to crew men working in the yard and offensive to adjacent residents. As a result, the problem of noise generation in railroad retarders has been a concern to industry for many years and, more recently, has attracted the attention of government.

Attempts have been made to reduce such noise to tolerable levels. In general, however, these efforts have achieved noise reduction at the expense of other necessary or desirable properties of the brake shoe, such as efficacy of retarding action and reduction in service life or have created other undesirable conditions. Such efforts have thus been unsatisfactory. These prior efforts have taken three general approaches: selection of materials for the brake shoes other than steel; altering the configuration of the brake shoes; or use of lubricants in the retarder.

U.S. Pat. Nos. 3,321,048; 4,003,451; and 3,716,114 showing the use of ductile iron, flake-graphite bearing iron, and asbestos, respectively, in the brakes shoes are typical of the first approach. While capable of reducing noise, due to the softness or lubricity of the materials, such shoes exhibited lessened service life due to increased wear and/or breakage as compared to conventional steel brake shoes. They therefore tended to be unsatisfactory from this standpoint.

U.S. Pat. No. 3,768,600 shows brake shoes in which the braking surface was altered to provide spaced, ribbed pads for noise reduction. However, the repeated shocks as the wheels moved from pad to pad were detrimental to the shoes and retarder mechanism and, in extreme cases, might damage the contents of the cars. In U.S. Pat. No. 4,003,451 the braking surface was varied along the length of the shoe. Analogous problems were encountered.

U.S. Pat. Nos. 3,838,646 and 3,874,298 show use of a water and oil emulsion as a lubricant to reduce noise. The spray of the lubricant in the air and/or its soaking in the ground, could be objectionable on safety and environmental grounds.

DISCLOSURE OF THE INVENTION

It is, therefore, the object of the present invention to provide an improved brake shoe structure that, through a unique combination of specific features, achieves noise reduction during retardation while maintaining or exhibiting other desirable aspects sought in such a structure. These aspects include adequate service life, absence of breakage, prevention of derailment, reduced shock and vibration, and ease of installation.

Briefly, the improved brake shoe structure includes a series of alternating long brake shoes and short brake shoes mountable on a plurality of adjacent brake beams arranged in tandem in the retarder. The length of the long brake shoe is such that the shoe symmetrically straddles two adjacent brake beams. The length of the short brake shoe is such that the shoe occupies the spacing on the brake beam between two long brake shoes. The long brake shoes are affixable to each of the adjacent brake beams at at least two points. This insures that the brake shoe is adequately supported across the two brake beams and avoids the breakage of brake shoes heretofore encountered due to shear or other forces. The use of alternating long brake shoes and short brake shoes also facilitates installation of the brake shoes in the retarder by providing lighter weight components, as compared with conventional brake shoes. Typically the long brake shoes are less than twice as long as the short brake shoes.

The long and the short brake shoes contain a plurality of spaced, slanting slots opening onto the braking surfaces of the shoes for interrupting the harmonics producing the screeching noise, thereby reducing the noise produced during retardation. The slant of the slots is coordinated with the width of the slots so that the braking surface of the shoes is always in contact with the car wheels as the wheels pass through the retarder. This prevents chatter or pounding as the wheels pass the shoe. The slots slant at an angle of 40° to the horizontal.

The brake shoes may be formed of steel or, for maximum noise reduction, from heat treatable ductile iron. With ductile iron shoes, the central portion of the long brake shoes contains a reinforcing fillet to reduce the possibility of breakage.

BEST MODE FOR CARRYING OUT THE INVENTION

Figure 1:
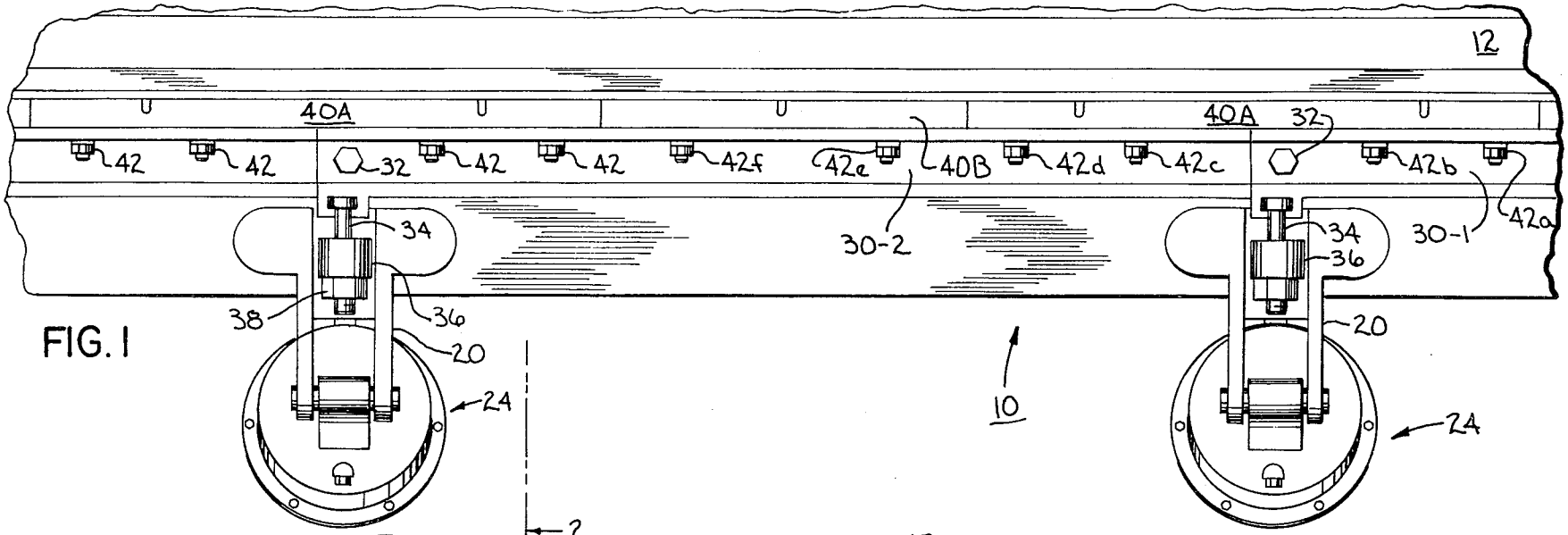
FIG. 1 is a fragmentary top view of a railroad car retarder incorporating the improved brake shoe structure of the present invention.
Figure 2:
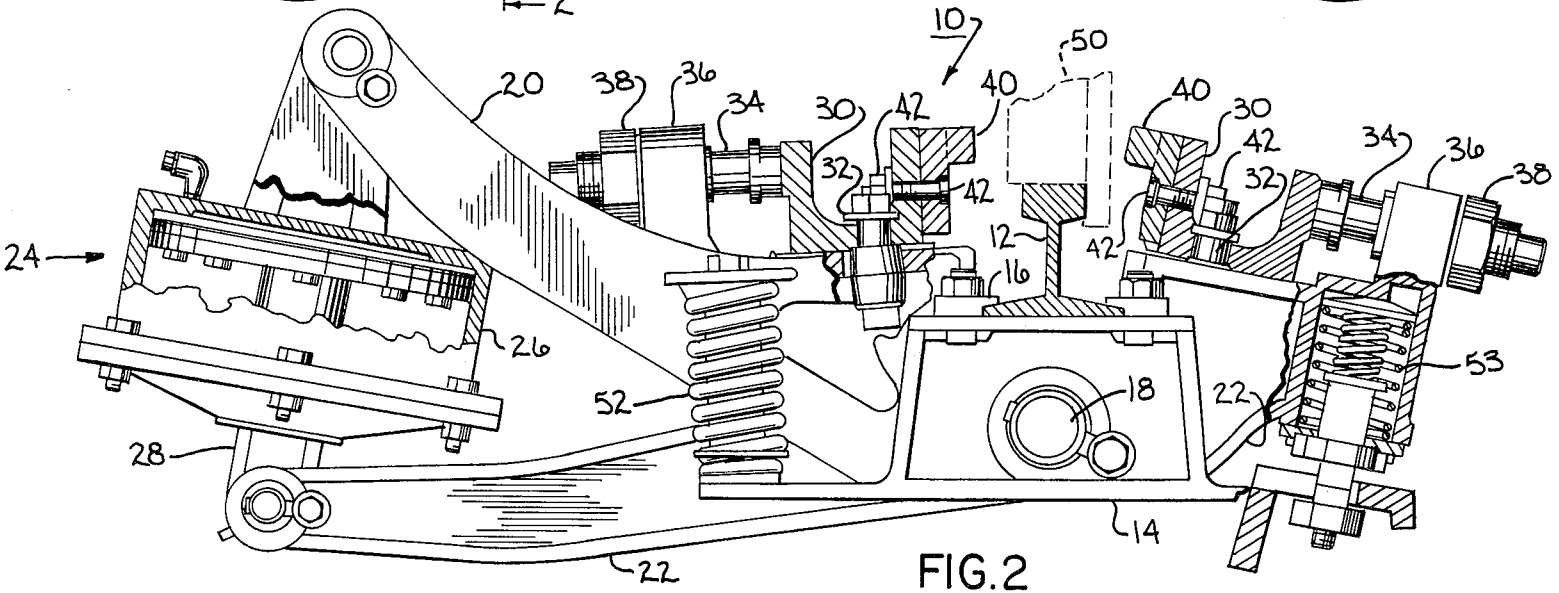
FIG. 2 is a cross-sectional view of the railroad car retarder and brake shoe structure taken along the line 2—2 of FIG. 1.

FIGS. 1 and 2 show railroad car retarder 10. Railroad car retarder 10 is illustrated in connection with a single rail 12, it being understood that a similar retarder is utilized in conjunction with the other rail, not shown, of the railroad track. Railroad car retarder 10 extends along either side of rails 12 for a predetermined distance dependent on the amount of braking action desired and other factors.

Railroad car retarder 10 includes rail supports 14 to which rail 12 is secured by lugs 16. Each rail support 14 contains a fulcrum pin 18 for a plurality of upper levers 20 and lower levers 22. Pin 18 passes through an end of upper lever 20 and through the center of lower lever 22. Fluid cylinder 24 has body 26 connected to the end of one of levers 20 and 22 and piston rod 28 connected to the other.

A brake beam 30 is mounted on each of upper lever 20 and lower lever 22. Brake beams 30 are generally U-shaped in cross-section and are bolted to levers 18 and 20 by bolts 32. The position of brake beams 32 on the levers may be adjusted by brake beam adjusting screws 34 extending through flanges 36 on the lever arms and containing adjustment nuts 38.

Figure 7:
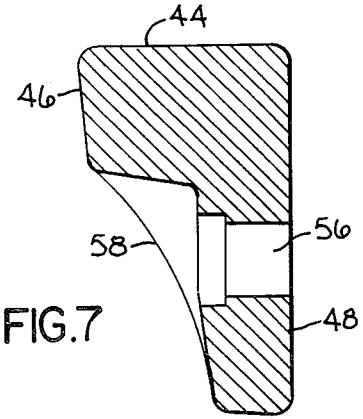
FIG. 7 is a cross-sectional view taken along the line 7—7 of FIG. 6.

Brake shoes 40 are mounted on brake beams 24 by bolts 42. As shown in FIGS. 2 and 7, brake shoes 40 are generally L-shaped in cross-section having a short arm 44 containing braking surface 46 supported by flange 48 mounted to brake beams 30 by bolts-nuts 42.

In operation, when it is desired to retard the motion of a car on rails 12, fluid cylinder 24 is actuated to extend piston rod 28. This pushes the ends of levers 20 and 22 apart and moves brake shoes 40 into contact with car wheel 50 shown in phantom on rail 12 in FIG. 2. Brake shoes 40 contact the inside and outside of wheel 50 to apply the retarding action. To terminate the retarding action, the fluid pressure is released in fluid cylinder 24. Return springs 52 and 53 moves the ends of levers 20 and 22 apart and disengages brake shoes 40 from car wheel 50.

As shown generally in FIG. 1, and in detail in FIGS. 3 and 5 and 6 and 8, the improved brake shoe structure of the present invention employs a series of alternating long brake shoes 40A and short brake shoes 40B. The length of the long brake shoe 40A is such that the shoe symmetrically straddles two adjacent brake beams 30, such as brake beams 30-1 and 30-2 shown in FIG. 1. Long brake shoe 40A thus extends along each of brake beams 30-1 and 30-2 an equal distance.

Long brake shoes 40A are fixed to each of the adjacent brake beams at at least two points as by bolts **42*a* and 42*b* for brake beam 30-1 and bolts 42*c* and 42*d* for brake beams 30-2. This insures that long brake shoe 40A** is adequately supported across the two brake beams and avoids breakage of the shoe in the central portion that has heretofore occurred due to shear, bending, or other forces.

The length of short brake shoes 40B is such as to occupy the spacing between two long brake shoes 40A on brake beam 30-2. Short brake shoe 40B is fastened to brake beam 30-2 by bolts **42*e* and 42*f*. Typically long brake shoe 40A is less than twice as long as short brake shoe 40B**.

The use of alternating long brake shoes 40A and short brake shoes 40B facilitates installation of the brake shoes in the retarder 10 by providing lighter weight components as compared to conventional brake shoes. For example, conventional brake shoes are typically approximately 74 inches long and weigh approximately 115 lbs. In an exemplary brake shoe structure of the present invention, long brake shoes 40A are 45 inches long and weigh approximately 70 lbs. Short brake shoes 40B are approximately 29 inches long and weigh approximately 45 lbs. The shorter than conventional components 40A and 40B facilitate casting and lessen warpage during heat treatment, hereinafter described.

Figure 3:
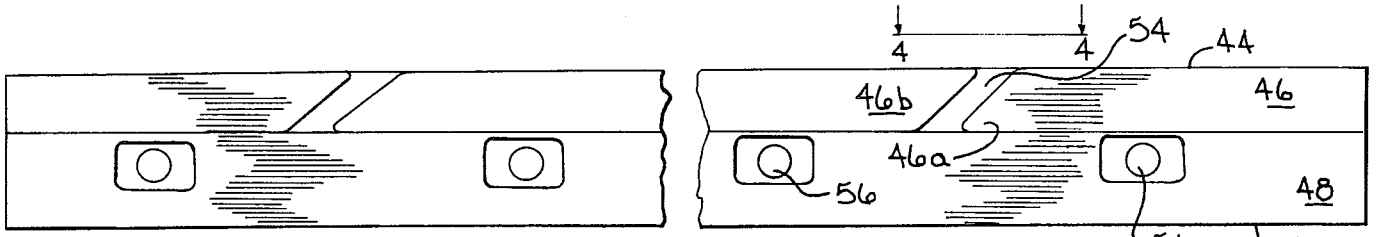
FIG. 3 is a front view showing the braking surface of a long brake shoe of the present invention.
Figure 4:
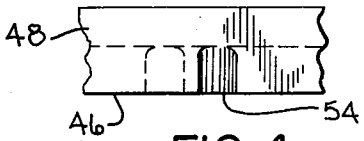
FIG. 4 is a fragmentary top view of the brake shoe of FIG. 3 taken along the line 4—4 of FIG. 3.
Figure 5:
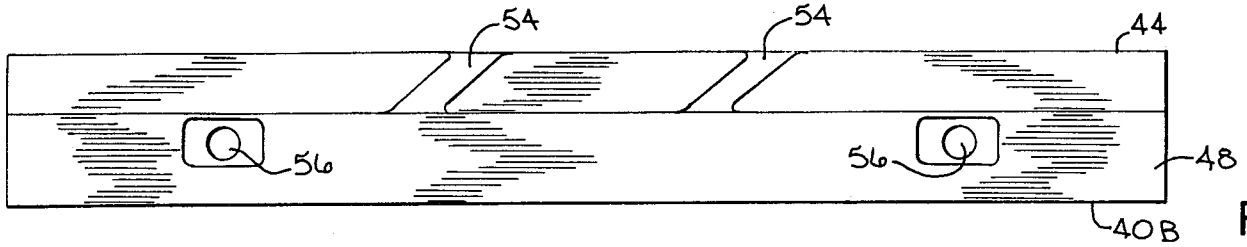
FIG. 5 is a front view showing the braking surface of a short brake shoe of the present invention.

Long brake shoe 40A and short brake shoe 40B are shown in detail in FIGS. 3 and 5, respectively. Braking surfaces 46 of brake shoes 40A and 40B contains slanting slots 54 in the surface thereof. Preferably slots 54 extend entirely through short arm 44 of the brake shoe, as shown in FIG. 4. Two slots 54 may be provided in long brake shoe 40A spaced from the central portion and end portions. A pair of slots 54 may also be provided in short brake shoe 40B as shown in FIG. 5. Slots 54 interrupt the development or build up of harmonic vibrations produced in the wheel by the shoe-wheel contact during car retardation, thereby reducing the noise resulting from such contact. The slots serve to lessen heating produced by the friction, also reducing noise production. Slots 54 are omitted in the central portion of long shoe 40A to insure maximum strength in the area between two adjacent brake beams 30-1 and 30-2 and from the end portions to eliminate breakage. The slots in long brake shoe 40A may be centered between holes 56 for bolts 42 to lessen any loss of mechanical strength.

The slant of slots 54 is coordinated with the width thereof so that at least a portion of the braking surface 46 of brake shoes 40A and 40B remains in contact with the car wheel 50 as the wheel passes the slot. To this end, the slant of the slot and the width thereof is such that the portions **46*a* and 46*b* formed to an acute angle by slot 54 overlap in a vertical direction. This prevents development of undesired chattering or pounding that would occur if wheel 50 lost and then re-established contact with braking surface 46. The loss in braking force is also minimized. In a typical embodiment of the invention, slots 54 in the braking surface 46** slant by an angle of 40° to the horizontal.

Brake shoes 40A and 40B shown in FIGS. 3, 4, and 5 may be formed of steel material so that a reduction in noise is achieved while, at the same time, long service life is provided.

Figure 6:
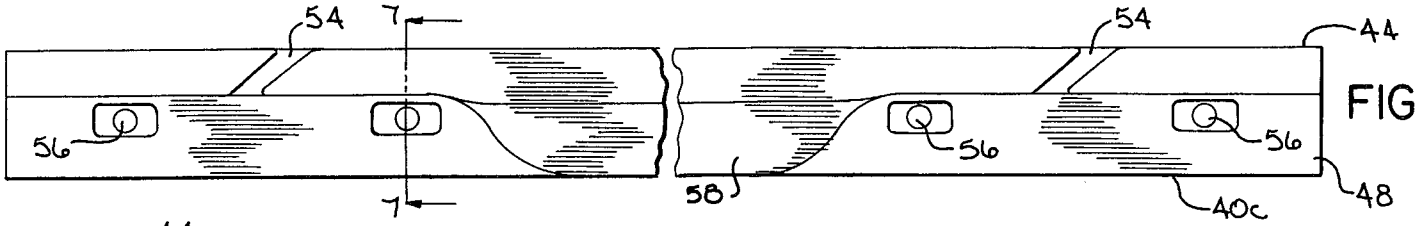
FIG. 6 is a front view of another embodiment of the long brake shoe.
Figure 8:
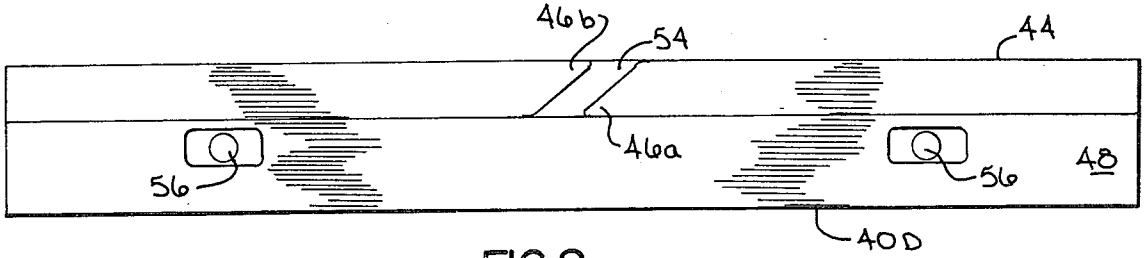
FIG. 8 is a front view of a short brake shoe suitable for use with the long brake shoe shown in FIGS. 6 and 7.

FIGS. 6, 7, and 8 show long brake shoe 40C and short brake shoe 40D. These brake shoes are formed of ductile iron to achieve maximum noise reduction. In short brake shoe 40D of FIG. 8 a single slot 54 may be sufficient to achieve desired noise reduction. Preferably, brake shoes 40C and 40D are formed of heat treatable ductile iron having a Brinnel hardness in a range of at least 196–293. A more preferred range is 217–269 Brinnell and a still more preferred range is 217–241 Brinnell. Such a ductile iron has sufficient hardness to provide adequate service life.

A heat treatable ductile iron of the type exhibiting at least 60,000 psi tensile strength, 45,000 psi yield strength, and 12% elongation is suitable for use in brake shoes 40C and 40D. Tensile strength is the stress at which the material fails; yield strength is the stress required to exceed the elastic limit and cause deformation of the material; and elongation is the amount of elongation or stretching at failure. A preferable ductile iron is one exhibiting 80,000 psi tensile strength, 55,000 psi yield strength and 6% elongation.

Long brake shoe 40D contains reinforcing fillet 56 in the central portion thereof, as shown in FIGS. 6 and 7 to insure that the shoe does not break between brake beams 30-1 and 30-2. Fillet 56 arches inwardly toward flange 48 to provide reinforcement while reducing the possibility of derailment.

We claim:

1. A low noise railroad car retarder brake shoe structure suitable for being supported by a plurality of adjacent brake beams arranged in tandem in the retarder for braking the wheel of a railroad car passing through the retarder along a rail, said structure comprising:

a series of alternating long brake shoes and short brake shoes affixable to the brake beams, the length of a long brake shoe being such that said shoe symmetrically straddles two adjacent brake beams while leaving a space on the brake beam in the central portion thereof, the length of a short brake shoe being such as to occupy the space on the central portion of the brake beam between two long brake shoes; said long brake shoe being affixable to each of the adjacent brake beams at at least two points, said long brake shoes having braking surfaces containing a plurality of slanting slots opening therein, said slots being omitted in the central portion of said long brake shoe, said short brake shoe having a braking surface containing at least one slanting slot opening therein.

2. The railroad retarder brake shoe structure according to claim 1 wherein said long brake shoes are affixable to each of the brake beams at two points.

3. The railroad retarder brake shoe structure according to claim 2 wherein the slots in said long brake shoe are centered between said affixing points.

4. The railroad retarder brake shoe structure according to claim 1 wherein said long brake shoes are less than twice as long as said short brake shoes.

5. The railroad retarder brake shoe structure according to claim 1 wherein the amount of slant of said slots and the width thereof is such that said braking surface of said brake shoe is always in contact with the railroad car wheel as it passes the structure.

6. The railroad retarder brake shoe structure according to claim 5 wherein said slots slant at an angle of 40° with respect to the horizontal.

7. The railroad retarder brake shoe structure according to claim 1 wherein said long brake shoe contains two slots.

8. The railroad retarder brake shoe structure according to claim 1 wherein said short brake shoe contains two slots.

9. The railroad retarder brake shoe structure according to claim 1 wherein said brake shoes are formed from steel.

10. The railroad retarder brake shoe structure according to claim 1 wherein said brake shoes are formed of ductile iron.

11. The railroad retarder brake shoe structure according to claim 10 wherein said brake shoes are formed of ductile iron having at least 60,000 psi tensile strength, 45,000 psi yield strength, and 12% elongation.

12. The railroad retarder brake shoe structure according to claim 11 wherein said brake shoes are formed of ductile iron having at least 80,000 psi tensile strength, 55,000 psi yield strength, and 6% elongation.

13. The railroad retarder brake shoe structure according to claim 10 wherein said brake shoes are formed of ductile iron having a hardness in a range of at least 196–293 Brinnell.

14. The railroad retarder brake shoe structure according to claim 13 wherein said brake shoes are formed of a ductile iron having a hardness in a range of 217–269 Brinnell.

15. The railroad retarder brake shoe structure according to claim 14 wherein said brake shoes are formed of a ductile iron having a hardness in a range of 217–241 Brinnell.

16. The railroad retarder brake shoe structure according to claim 10 wherein said long brake shoe includes a reinforcing fillet in the central portion thereof.

17. The railroad retarder brake shoe structure according to claim 16 wherein said fillet is inwardly arched.

* * * * *